US005611323A

United States Patent [19]

Townley

[11] Patent Number: 5,611,323

[45] Date of Patent: Mar. 18, 1997

[54] ARROW RETENTION DEVICE

[76] Inventor: Richard Townley, Box 957, Gunnison, Utah 84634

[21] Appl. No.: 541,329

[22] Filed: Oct. 10, 1995

[51] Int. Cl.[6] ..... F41B 5/22

[52] U.S. Cl. ..... 124/44.5; 124/24.1

[58] Field of Search ..... 124/24.1, 44.5, 124/86

[56] References Cited

U.S. PATENT DOCUMENTS

| | | | |
|---|---|---|---|
| 4,407,261 | 10/1983 | Elliott | 124/44.5 |
| 4,685,439 | 8/1987 | Cosentino | 124/44.5 |
| 5,022,378 | 6/1991 | Rhodehouse et al. | 124/44.5 |
| 5,065,731 | 11/1991 | Smith | 124/44.5 |
| 5,095,884 | 3/1992 | Mertens | 124/44.5 |
| 5,394,858 | 3/1995 | Karolian | 124/44.5 |
| 5,400,763 | 3/1995 | Mazza | 124/44.5 |
| 5,413,084 | 5/1995 | Haggard | 124/44.5 |

*Primary Examiner*—John A. Ricci
*Attorney, Agent, or Firm*—Thorpe, North & Western, L.L.P.

[57] ABSTRACT

An arrow retention device is disclosed including a frame/guide which is attachable to a bow so as to limit the flight path of an arrow, a holding mechanism which is disposed along the frame/guide, and a release mechanism which selectively moves the holding mechanism between a closed position, wherein the holding mechanism holds the arrow, and an open position wherein the holding mechanism does not hold the arrow. The present invention includes an embodiment for use when assuming an overdraw position, and one which can be used with a conventional arrow. The mechanism simultaneously prevents an arrow from being knocked out of place and protects the user of the bow from injury.

20 Claims, 4 Drawing Sheets

ARROW RETENTION DEVICE

BACKGROUND OF THE INVENTION

The present invention relates to a device for retaining arrows on a bow, and in particular, to a device for retaining an arrow adjacent the bow when the arrow is in a resting position.

With the advent of the compound bow, the popularity of bow hunting and target competitions using bows and arrows have become very popular. When one is bow hunting or otherwise using the bow in situations which require movement, it is common for the user to keep an arrow in a ready position with its hock (the groove at the rear of the arrow) mounted on the bow string, and the arrow shaft disposed adjacent the bow. Thus, the hunter is ready to shoot within a very short time after seeing the desired game or target. If the arrow were not prepositioned, the game would often have an opportunity to escape before an arrow could be released.

In a preshooting position, however, the arrow may easily be knocked out of position by branches, brush, or other obstacles. To overcome this, many hunters use their forefinger to hold the arrow in place. Of course, this can become very tiring when hunting, as using the forefinger in such a manner generally requires the wrist to be in an unnatural position. If the hunter maintains this position for several hours, the fatigue caused by such a position can interfere with his or her ability to shoot once game is sighted.

To overcome these concerns, a mechanical device was developed for holding the arrow adjacent to the bow and in contact with the bow string. The device, described in detail in U.S. Pat. No. 4,577,612, has an arrow clamp which holds the arrow against the bow, and a trigger for moving the arrow out of the way when the person desired to shoot the arrow. The interconnections between the trigger and the arrow clamp are shown to be a spiral passage way and a rack and pinion gear.

The use of the device with present hunting techniques raises several problems. First, the triggering mechanism and arrow clamp tend to have a distinctive clicking sound when the arrow clamp is released. If the sound is sufficiently loud, the sound will scare off the game before the arrow can be delivered. Second, the positioning of the clamp on the bow significantly limits the length of arrows which may be shot while using the device. Specifically, the current trend is to shoot shorter arrows as the arrows obtain a higher velocity and are generally more accurate than their longer counterparts. The short length of the arrows causes a situation known as overdraw, wherein the head of the arrow is actually disposed rearwardly of the bow when the user is in a full draw prior to shooting.

Those skilled in the art will appreciate that having a trigger actuated clamp disposed along the bow will significantly interfere with shooting such short arrows. To achieve a full draw, the arrow clamp must be released so that it will not interfere with the head of the arrow. Thus, the clicking sound will proceed release of the arrow by a full second or more. Additionally, if the clamp were to return to its original position due to being bumped or some other accident, the arrow clamp would be disposed right in the flight line of the arrow. If the arrow were to be released, it could ricochet and injure the user or other persons in his or her hunting party.

Yet another concern with mechanically complex release mechanisms is that they are susceptible to damage and failure. For example, if sand or some other debris enters the release, it may become jammed in an open or closed position. In such a situation, the archer must either attempt to disassemble the mechanism in the field, or cancel the remainder of the outing.

Thus, there is a need for an arrow retention device which holds the arrow in such a manner as to permit full draw of even short arrows prior to release of the device, and thus the arrow. Such a device should also shield the user and others in the event that the short arrow slips while it is being fired.

SUMMARY OF THE INVENTION

Thus, it is an object of the present invention to provide an improved arrow retention device which is inexpensive and easy to use.

It is another object of the present invention to provide such an improved arrow retention device which allows the user to make a full draw even with short arrows without releasing the mechanism which holds the arrow in contact with the bow string and adjacent to the bow.

It is yet another object of the present invention to provide such an arrow retention device which protects the user when the user is shooting short arrows from an overdraw position.

It is still another object of the invention to create such an arrow retention device which is quiet, and which can be operated with very little effort.

The above and other objects of the invention are realized in specific illustrated embodiments of an arrow retention device including an elongate overdraw frame attachment which is attachable to a bow so as to extend rearwardly therefrom, a holding mechanism which is disposed on the elongate overdraw frame rearwardly from the bow, and a release mechanism which selectively moves the holding mechanism between a closed position, wherein the holding mechanism holds the arrow, and an open position wherein the holding mechanism does not hold the arrow. The present arrangement holds the arrow rearward from the bow so as to enable the archer to overdraw without first releasing the holding mechanism.

In accordance with one aspect of the invention, a deflectable arrow support is disposed on the arrow support device between the bow and the bow string to support the arrow through the entire length of the draw. Preferentially, the holding mechanism is disposed adjacent the deflectable arrow support so that the holding mechanism will not interfere with a full draw on even a short arrow.

In accordance with another aspect of the present invention, the arrow retention device includes a guide which limits the direction of travel for the arrow in overdraw situations so as to prevent the arrow from slipping and injuring the user. The guide typically includes a horizontal flange which prevents the arrow from turning downwardly and injuring the arm or hand of the archer. The guide also typically includes a flange which extends upwardly at a sufficient angle to limit lateral movement of the arrow. The two flanges are usually mounted to a conventional arrow support arm which is attached to the bow, so as to provide a generally three sided guide to protect the archer when shooting from the overdraw position.

In accordance with another aspect of the invention, the release mechanism comprises a rotatable lever which moves the holding mechanism between closed and open positions. The rotatable lever is easy to operate and is virtually silent so that the release mechanism does not scare away game.

In accordance with yet another aspect of the present invention, the frame may be shortened and mounted on the bow for use with longer arrows. The rotatable lever and holding device allows the arrow to be released without the substantial noise or mechanical problems present with prior art attempts to hold the arrow.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Reference will now be made to the drawings in which the various elements of the present invention will be given numeral designations and in which the invention will be discussed so as to enable one skilled in the art to make and use the invention. It is to be understood that the following description is only exemplary of the principles of the present invention, and should not be viewed as narrowing the pending claims.

Figure 1:
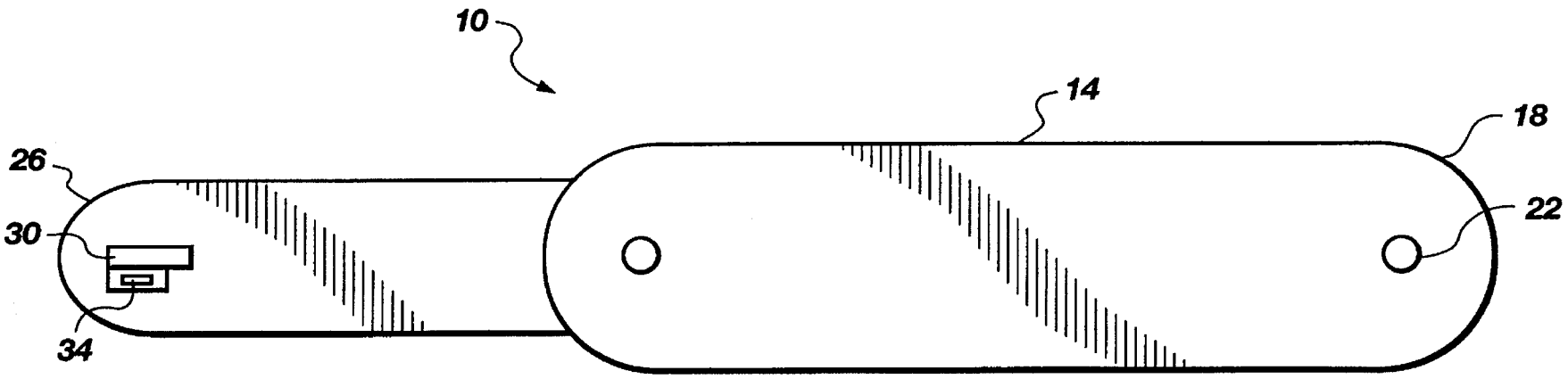
Fig. 1 (PRIOR ART)
FIG. 1 shows a side view of an arrow support made in accordance with the teachings of the prior art.

Referring to FIG. 1, there is shown a side view of an arrow support, generally indicated at 10, made in accordance with the teachings of the prior art. The arrow support 10 includes an arm 14 which attaches at a first end 18 to a bow, not shown. Typically, the arm 14 will be attached to the bow by placing a screw through a hole 22 disposed in the first end 18 and securing the arm to the bow. However, other attachment methods also may be used.

Disposed on a second end 26 of the arm 14 is a pair of deflectable arrow supports 30 and 34, respectively. A first deflectable arrow support 30 typically is formed by a piece of metal or other rigid but flexible material to extend outwardly from the arm 14 and contact the side of an arrow in a manner shown in FIG. 3. The first deflectable arrow support 30 provides lateral stabilization to the arrow, and deflects out of the way slightly when the arrow is shot.

Figure 3:
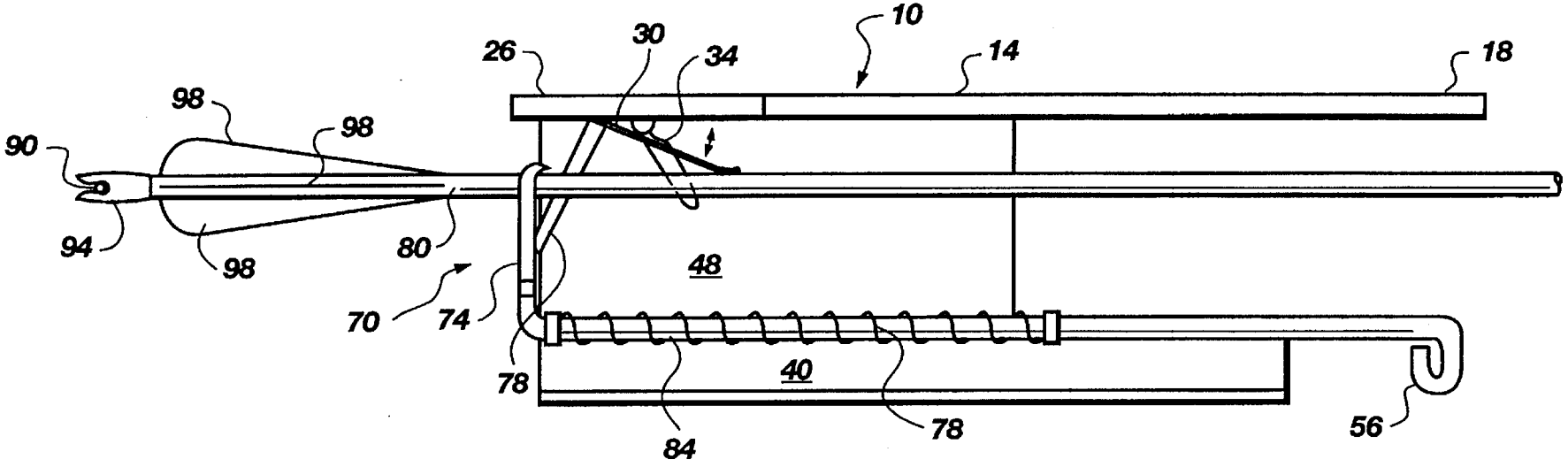
FIG. 3 shows a top view of the arrow retention device of the present invention mounted to the arrow support and an arrow mounted therein.

Disposed below the first deflectable arrow support is a second deflectable arrow support 34 which is formed of a small piece of curved metal. The second deflectable arrow support is biased into a position in which it is disposed under an arrow when the arrow's hock is mounted on the bowstring (FIG. 3). The biasing of the second deflectable arrow support 34 is sufficiently weak, however, that the fin of an arrow easily deflects the support as the arrow is shot from the bow. Thus, the second deflectable arrow support provides little interference with the arrow being shot.

Those skilled in the art will appreciate that the arrow support shown in FIG. 1 is particularly beneficial when shooting from an overdraw position. Because the head of the arrow is behind the bow, the conventional arrow support provided by the bow is not available. Thus, support must be provided between the bow and the bow string. The first and second deflectable arrow supports provide that support.

Figure 2:
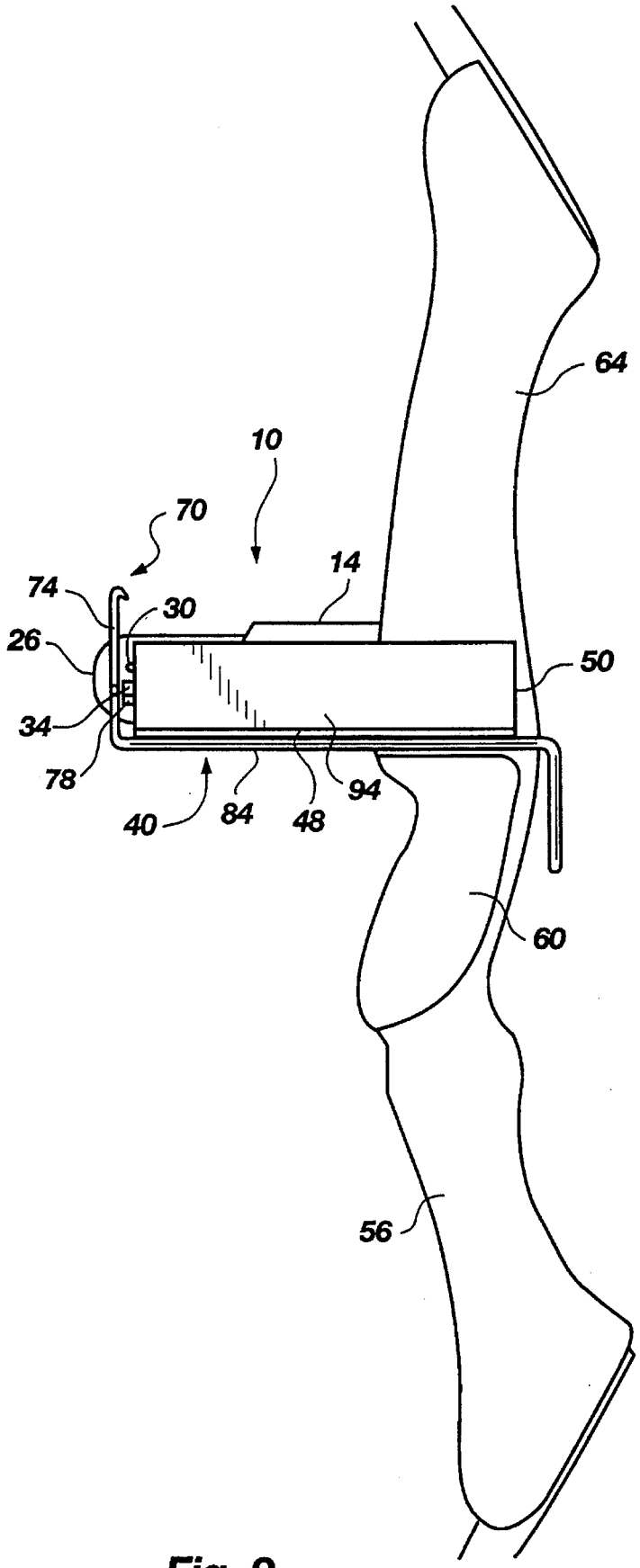
FIG. 2 shows a side view of an arrow retention device mounted to the arrow support of the prior art in accordance with the principles of the present invention, and a fragmented view of a bow to which the device is mounted.

Referring now to FIG. 2, there is shown a side view of an arrow retention device, generally indicated at 40, which is mounted to the prior art arrow support 10 discussed with respect to FIG. 1. The arrow retention device 40 includes an elongate overdraw frame attachment which includes a first flange 44 which is disposed to extend upwardly, and a second flange 48, disposed generally horizontally. The second flange 48 is discussed in additional detail with respect to FIG. 3.

At a first end 50 of the elongate overdraw frame attachment 40 is a lever 56. The lever 56 extends downwardly and slightly outwardly from the elongate overdraw frame attachment 40 and is positioned adjacent the grip 60 of the bow 64. As will be apparent to those skilled in the art, the view shown in FIG. 2 is that of a bow for people who are left handed, or who prefer to shoot with their right hand holding the bow 64. While the embodiment shown involves pushing the level with one's fingers, the same arrangement would allow a person shooting with the opposite hand to pull the lever 56 toward the bow 64 with his or her fingers. The positioning of the lever 56 adjacent the grip 60 allows the user to move the lever without releasing the bow or even substantially lessening one's grip on the bow.

The lever 56 is connected to an elongate rod 84 which attaches the lever to a holding mechanism, generally indicated at 70. The holding mechanism 70 includes a curved catch 74 which is moveable between a closed position—in which the arm rests on an arrow to hold the arrow in contact with the bow string and the first and second deflectable supports 30 and 4, respectively—and an open position—in which the catch is moved to a position away from the arrow so that, it will not interfere with shooting of the arrow. While the catch 74 is preferentially curved, any shape may be used whereby the catch holds the arrow in the appropriate place.

The catch 74 is biased into the closed position by a spring 78 which is attached at one end to the catch and at a second end to the second flange 48. Of course, any very resilient material could be used in placed of the spring, such as a rubber band. Additionally, various attachment positions may be provided to adjust tension on the spring 78 and leverage position with respect to the catch 74. For example, a spring could be disposed coaxially along the elongate rod 84 as shown in FIG. 3.

When a user is drawing an arrow back into the overdraw position, the user's hand will generally be kept free from the lever 56. The catch 74 of the holding device 70 remains on the arrow to keep the arrow in the appropriate place. Once a full draw has been achieved and the user is ready to shoot the arrow, the lever 56 is pushed toward the bow 64, causing the catch 74 of the holding mechanism 70 to be rotated away from the arrow. The arrow can then be released to strike the intended target. Because of the simple interaction between the lever 56 and the catch 74 of the holding mechanism, there is no need for gears or other moving parts which make noise and which can become jammed with sand or debris. When the present invention is used, there is little if any noise made by moving the lever 56 to rotate the catch 74 between closed and open positions.

Referring now to FIG. 3, there is shown a top view of the arrow retention device 40 of the present invention mounted to the prior art arrow support 10, with an arrow 80 being disposed between the two. The arrow 80 is in a resting position, i.e. not in flight.

The prior art arrow support 10 includes the arm 14 for attachment at a first end 18 thereof to the bow (not shown). Adjacent the second end 22 of the arm 14 are the first and second deflectable arrow supports 30 and 34, respectively. The first deflectable arrow support 30 provides lateral support to the arrow, while the second deflectable arrow support extends underneath the arrow 80. When the arrow 80 is shot, both the first and second deflectable arrow supports are deflected out of the way (to different degrees).

The arrow 80 is held on the first and second deflectable supports 30 and 34, respectively, by the catch 74 of the holding mechanism 70. The catch 74 is held against the arrow 80 until the biasing of the spring 78 is overcome. This is achieved by moving the lever 56 toward the plane of the bow (not shown) so as to rotate the elongate rod 84. The elongate rod 84 rotates the catch 74 away from the arrow and plane of the bow, and into an open position after which the arrow may be released.

The position of the holding mechanism 70 adjacent to the first and second deflectable arrow supports 30 and 34 allows an arrow 80 to be pulled into a fully drawn overdraw position without necessitating the release of the holding mechanism 70. The arrow 80 will typically be drawn back by pulling away from the bow on the bow string 90 and the hock 94 of the arrow 80. Once the arrow is in the fully drawn position, the lever 56 is pressed so as to move the catch 74 out of the way of the fins 98 of the arrow so that the arrow may be shot accurately.

In addition to holding the arrow 80 in a proper position on the first and second deflectable arrow supports 30 and 34, respectively, the arrow retention device 40 also protects the user. The first and second flanges 44 and 48, respectively provide a bottom and lateral guide opposite the arm 14 of the conventional arrow support 10 so as to channel the arrow in the proper direction. One hazard of shooting short arrows is the risk that the head of the arrow may fall shortly before release and cause the arrow 80 to penetrate the arm of the person using the bow. It is for this reason that the prior art support device was developed. The present invention, however, supplies much better protection, as the arrow cannot be miss-shot into the arm of the user even if it comes off the supports prior to firing. Rather, it will contact the first flange 44 and/or the second flange 48 and be channeled away from the user.

Typically the arrow retention device 40 will be attached to the arm 14 of the prior art support by a plurality of screws or some similar attachment method. However, those skilled in the art will appreciate that the prior art support could be omitted with the deflectable supports being attached to the arrow retention device 40 of the present invention. Alternately, the two pieces could be formed integrally with one another.

Figure 4:
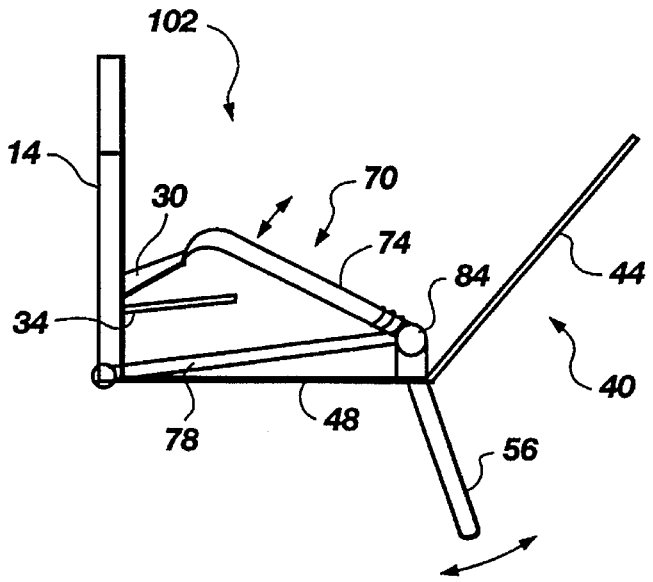
FIG. 4 shows an end view of the arrow retention device of the present invention and the arrow support of the prior art.

Referring now to FIG. 4, there is shown an end view of the embodiments shown in FIGS. 2 and 3. The arm 14 and first and second deflectable supports 30 and 34, respectively, of the prior art are labeled in accordance with the description regarding FIGS. 2 and 3. Likewise, the arrow retention device 40 of the present invention is also labeled in a similar manner. The lever 56 acts as a release means for the holding mechanism 70, which includes the catch 74 and the biasing spring 78. This is typically effectuated by the rotatable elongate rod 84 which connects the release means to the holding mechanism 70.

The end view of FIG. 4 shows in additional detail the channel, generally indicated at 102 which is formed by the arm 14, the first flange 44 and the second flange 48. This channel prevents the arrow from misfiring in such a way that it injures the user of the arrow. As will be appreciated, the arm 14 of the prior art device could actually direct the arrow into the arm of the user if the arrow fell off of the deflectable supports 30 and 34. However, with the present invention, this is virtually impossible.

Figure 5:
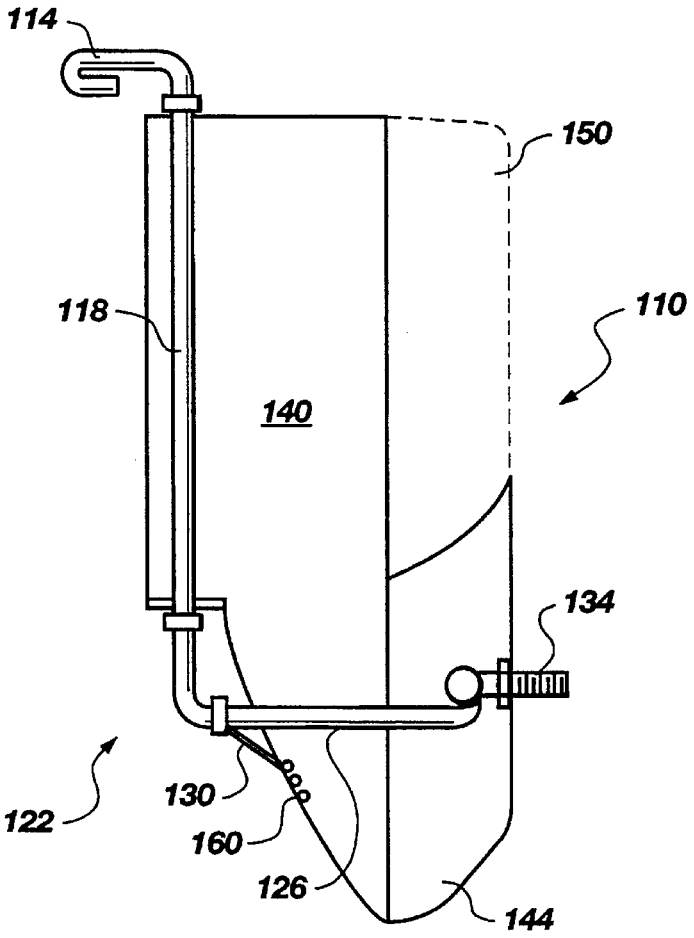
FIG. 5 shows an alternate embodiment of the present invention.

Referring now to FIG. 5, there is shown a top view of an alternate embodiment of the present invention. The arrow retention device, generally indicated at 110 includes a lever 114 which is attached to an elongate, rotatable rod 118 in a similar manner to that discussed above. The elongate rod 118 is, in turn, attached to the holding mechanism, generally indicated at 122. The holding mechanism includes a catch 126 which is biased in the closed position by a biasing spring 130. The spring 130 is mounted to a first shield or flange 140 and biases the catch 126 into a position in which it is disposed adjacent an arrow support 134 which is mounted on a second shield or flange 144. The second flange 144 extends generally upwardly to limit lateral movement of an arrow held by the retention device 110.

As was shown in FIG. 1, the first shield or flange 140 is disposed generally horizontally to prevent an arrow from falling downwardly and striking the user of the bow. The first and second flanges, 140 and 144, respectively, are arranged so that a bow will fit in the area identified at 150. The first flange 140 also includes several attachment points 160 which can be used to vary the tension on the spring 126, and thus the force with which the catch 126 rests on the arrow (not shown).

While not providing the significant overdraw protection of the prior embodiment, the arrow retention device 110 of FIG. 5 does constitute a significant improvement over the prior art. It is easier to use, makes less noise, and is less susceptible to damage to sand and debris.

Thus, there is disclosed an improved arrow retention device for holding arrows. Those skilled in the art will recognize numerous modifications which can be made without departing from the scope and spirit of the invention. The appended claims are intended to cover such modifications.

What is claimed is:

1. An arrow retention device for mounting on a bow, the device comprising:

an elongate overdraw frame attachment for attaching to the bow and for extending rearwardly therefrom and including an arrow support means;

holding means rearwardly attached to the elongate frame attachment for selectively securing an arrow adjacent the elongate frame attachment when the arrow is in a resting position, the holding means having an open position and a closed position wherein the holding means secures the arrow adjacent the elongate frame, and including a biasing means for biasing the holding means in the closed position; and release means disposed along the elongate frame attachment and in communication with the holding means for selectively moving the holding means from the closed position to the open position.

2. The arrow retention device of claim 1, wherein the holding means comprises a catch for holding an arrow, and a biasing means attached to the catch to bias the catch into forceful contact with the arrow.

3. The arrow retention device of claim 2, wherein the catch has a curved portion for wrapping at least partially around the arrow.

4. The arrow retention device of claim 1, wherein the elongate frame member has a first end attached to the bow and a second end disposed opposite the first end, and wherein the release means is disposed at least partially adjacent the first end of the elongate frame attachment and the holding means is disposed adjacent the second end of the elongate frame attachment.

5. The arrow retention device of claim 4, wherein the release means comprises a lever disposed adjacent the bow, and a rotatable shaft extending rearwardly adjacent the elongate frame attachment to the holding means, the shaft being positioned such that movement of the lever rotates the shaft and moves the holding means between the closed and open positions.

6. The arrow retention device of claim 1, wherein the biasing means comprises a resilient member having first and second ends, the first end being attached to the holding means and the second end attached to the elongate overdraw frame attachment.

7. The arrow retention device of claim 6, wherein the resilient member attaches to the elongate overdraw frame member at an attachment point, and wherein the device further comprises adjustment means for adjusting the position of the attachment point so as to adjust tension in the resilient member.

8. The arrow retention device of claim 6, wherein the holding means comprises a catch member, and wherein the resilient member comprises a spring.

9. The arrow retention device of claim 1, wherein the elongate overdraw frame attachment further comprises guide means for limiting directions which the arrow positioned adjacent the elongate overdraw frame attachment may travel.

10. The arrow retention device of claim 9, wherein the guide means comprises a generally horizontally disposed flange forming a part of the elongate overdraw frame attachment.

11. The arrow retention device of claim 10, wherein the guide further comprises a flange extending generally upwardly from the generally horizontally disposed flange so as to limit lateral movement of the arrow.

12. The arrow retention device of claim 11, wherein the biasing means comprises a spring attached at a first end thereof to the holding means and at a second end thereof to the generally horizontally disposed flange.

13. An arrow retainer/guide for attachment to a bow laced with a string, the retainer/guide comprising:

guide means extending rearwardly from the bow toward the string for channeling the arrow;

holding means disposed along the guide means for selectively holding the arrow within the guide means, the holding means being movable between an open position and a closed position in which the holding means holds the arrow within the guide means, the holding means comprising a biasing means for biasing the holding means into the closed position; and release means disposed adjacent the bow and in communication with the holding means for overcoming the biasing means and moving the holding means into the open position.

14. The arrow retainer/guide of claim 13, wherein the guide comprises a first, generally horizontally disposed shield for preventing an arrow disposed in the guide from traveling downwardly, and a second, upwardly extending shield attached to the generally horizontally disposed shield for limiting lateral movement of the arrow.

15. The arrow retainer/guide of claim 14, wherein the holding means comprises a catch and a resilient member attached to the catch and to the guide to bias the catch toward the generally vertically disposed shield, so as to hold the arrow between the catch and the upwardly extending shield.

16. The arrow retainer/guide of claim 15, wherein the release means comprises a lever connected to the catch for moving the catch away from the upwardly extending shield.

17. The arrow retainer/guide of claim 16, wherein the catch is disposed at one end of the guide and the lever is disposed at an opposing end of the guide, and wherein the lever is attached to the catch by a rotatable shaft such that movement of the lever toward the plane of the bow moves the catch from the closed position into the open position.

18. An arrow retainer/guide for attachment to a bow adjacent the grip of the bow, the retainer/guide comprising:

guide means attached to the bow for channeling the arrow, the guide means comprising at least one shield extending from the bow to limit movement of the arrow;

holding means disposed along the guide means for selectively holding the arrow within the guide means and adjacent the shield, the holding means being movable between an open position and a closed position in which the holding means holds the arrow within the guide means, the holding means comprising a biasing means for biasing the holding means into the closed position; and release means disposed adjacent the bow and in communication with the holding means for overcoming the biasing means and moving the holding means into the open position, the release means comprising a rotatable lever positionable adjacent the grip of the bow.

19. The arrow retainer/guide of claim 18, wherein the guide further comprises an arrow support attached to the at least one shield for supporting the arrow while the arrow is in a resting position.

20. The arrow retainer/guide of claim 18, wherein the guide comprises a first shield disposed in a generally horizontal position and a second shield extending upwardly from the first shield so as to form a channel therebetween and limit lateral and vertical movement of the arrow.

* * * * *